US009157165B2

(12) United States Patent
Hirano et al.

(10) Patent No.: US 9,157,165 B2
(45) Date of Patent: Oct. 13, 2015

(54) METHOD OF PRODUCTION OF CHEMICALLY TREATED STEEL SHEET

(75) Inventors: Shigeru Hirano, Tokyo (JP); Akira Tachiki, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 0 days.

(21) Appl. No.: 12/799,404

(22) Filed: Apr. 22, 2010

(65) Prior Publication Data

US 2011/0259756 A1 Oct. 27, 2011

(51) Int. Cl.
*C25D 9/10* (2006.01)

(52) U.S. Cl.
CPC ..... *C25D 9/10* (2013.01)

(58) Field of Classification Search
CPC ..... C25D 9/10
USPC ..... 205/82, 101
See application file for complete search history.

(56) References Cited

U.S. PATENT DOCUMENTS 3,903,237 A * 9/1975 Smith et al. ..... 423/54
4,464,232 A * 8/1984 Wakano et al. ..... 205/95
5,456,816 A * 10/1995 Watanabe et al. ..... 205/109
5,858,196 A * 1/1999 Ikenaga ..... 205/82
6,083,374 A * 7/2000 Kopp ..... 205/101
6,521,112 B1 * 2/2003 Balisky ..... 205/81
2011/0214784 A1 * 9/2011 Inbe et al. ..... 148/22

FOREIGN PATENT DOCUMENTS

JP 54-68734 6/1979
JP 2005-325402 11/2005

* cited by examiner

*Primary Examiner* — Bryan D. Ripa
(74) *Attorney, Agent, or Firm* — Kenyon & Kenyon LLP

(57) ABSTRACT

A method of production of a chemically treated steel sheet using cathode electrolysis to form a chemically treated coating which stably resupplies Zr ions in a treatment solution and uses an insoluble anode to continuously and stably treat a steel strip by cathode electrolysis in a treatment solution containing Zr ions and fluorine ions, characterized by using two or more types of zirconium compounds selected from predetermined Zr compounds to resupply zirconium ions in a plating solution consumed by the cathode electrolysis during the cathode electrolysis and maintaining a content of ions in the plating solution at zirconium ions: 0.05 to 30 g/liter, fluorine ions: 0.5 to 10 times the content of the zirconium ions, and ions derived from said two or more types of zirconium compounds other than zirconium ions and fluorine ions: not more than 10 times the content of the zirconium ions in performing the cathode electrolysis.

4 Claims, 2 Drawing Sheets

METHOD OF PRODUCTION OF CHEMICALLY TREATED STEEL SHEET

TECHNICAL FIELD

The present invention relates to a method of production of chemically treated steel sheet using an insoluble anode to continuously treat a steel strip by cathode electrolysis by a treatment solution containing Zr ions and fluorine ions and deposit a Zr-based chemically treated coating.

BACKGROUND ART

Steel sheet products are treated to secure corrosion resistance, rustproofing, coating adhesion, and other characteristics by treating the surface of the steel sheet, or the surface of the steel sheet after being plated by Sn, Zn, Ni, etc., by cathode electrolysis in a treatment solution containing hexavalent Cr (electrolytic Cr acid treatment) so as to form a chromate coating comprised of Cr oxide or Cr metal and Cr oxide.

For example, the Sn-plated steel sheet (tinplate) used as steel sheet for containers and TFS (tin free steel) not using Sn are given corrosion resistance, coating adhesion, film adhesion, and discoloration resistance by giving their outermost surfaces a chromate coating.

In recent years, interest in the environment has been rising and restrictions on the use of hexavalent Cr are being considered. Therefore, the method of applying a chemically treated coating made of a Zr compound as a new coating to take the place of chromate coatings while using existing electrolytic Cr acid treatment facilities has been proposed.

For example, PLT 1 proposes "a method of surface treatment of tin-plated steel sheet and tin-plated cans", while PLT 2 proposes "a method of surface treatment of a tin- or tin-alloy plated steel material".

In these inventions, the method is disclosed of treatment by cathode electrolysis in a treatment solution containing Zr fluoride or a Zr compound using a Pt or other insoluble anode as a counter electrode so as to obtain a Zr-based chemically treated coating with superior performance.

CITATION LIST

Patent Literature

PTL 1: Japanese Patent Publication (A) No. 54-68734
PTL 2 Japanese Patent Publication (A) No. 2005-325402

SUMMARY OF INVENTION

Technical Problem

To provide a Zr-based chemically treated coating on an industrial basis, it is best to form it on a continuous electroplating line. Further, if using an insoluble anode for the anode placed in the treatment tank, line stoppages due to replacement of electrodes can be eliminated, so the efficiency is better. At this time, the method of resupply of Zr ions in the treatment solution is important.

Zr ions form complexes with fluorine ions in the treatment solution so are stably present. Further, due to the cathode electrolysis, the hydrogen ions etc. are reduced and the pH in the vicinity of the steel sheet being plated rises, so a Zr oxide or Zr phosphate or other Zr compound coating is formed. As a result, the Zr ions and phosphate ions in the treatment solution are consumed, but the fluorine ions are not consumed, so remain in the treatment solution.

If resupplying the consumed Zr ions by Zr fluoride, the concentration of fluorine ions in the treatment solution further rises. For this reason, stable formation of a Zr-based chemically treated coating becomes difficult.

If resupplying the Zr ions by a Zr compound other than Zr fluoride, the ions derived from the Zr compound (for example, nitrate ions, carbonate ions, etc.) will build up. If these ions are present in excess in the treatment solution, the Zr-based chemically treated coating will not longer be stably formed.

On a continuous electroplating line, when the steel sheet leaves the treatment tank, the treatment solution remains deposited on the surface of the steel sheet and therefore the treatment solution is taken out. For this reason, the fluorine ions and other ions derived from Zr compounds charged when resupplying the Zr ions do not build up without limit, but are kept to a certain fixed concentration. However, the amount of treatment solution taken out is extremely small, so even if utilizing this action of the steel sheet in taking out the treatment solution, the concentration at which the fluorine ions and other ions derived from Zr compounds are kept will be high and therefore the above problem cannot be solved.

If periodically draining a certain amount of the treatment solution, it would be possible to lower the concentration at which the fluorine ions and other ions derived from Zr compounds are kept to an extent not affecting the Zr-based chemical treatment. However, draining an expensive treatment solution containing Zr ions would result in a large increase in costs.

Ideally, it is preferable to dissolve Zr metal to resupply Zr ions in the treatment solution. However, Zr metal has an extremely slow speed of dissolution, so this method cannot be used industrially.

Due to the above situation, a method for resupplying Zr ions enabling a Zr-based chemically treated coating to be stably and continuously applied by a continuous electroplating line provided with an insoluble anode has been desired.

The present invention was made in consideration of this problem and has as its object the provision of a method of production of a chemically treated steel sheet using cathode electrolysis to form a chemically treated coating which stably resupplies Zr ions in a treatment solution and uses an insoluble anode to continuously and stably treat a steel strip by cathode electrolysis in a treatment solution containing Zr ions and fluorine ions.

Solution to Problem

The inventors studied methods for resupply of Zr ions enabling a Zr-based chemically treated coating to be continuously and stably formed even if using an insoluble anode. Specifically, they investigated the effects of the concentration of halogen ions, carbonate ions, ammonium ions, nitrate ions, etc. on the adhesion and corrosion resistance of Zr-based chemically treated coatings. As a result, they obtained the following findings.

(i) Depending on the Zr compound, even if the ions derived from the Zr compound contaminate the treatment solution, if below a certain fixed concentration, they will not have any affect on the performance of the Zr-based chemically treated coating.

(ii) Even if ions derived from a plurality of Zr compounds contaminate the treatment solution, if the individual ions have concentrations below certain fixed concentrations, they will not have any affect on the performance of the Zr-based chemically treated coating.

(iii) The allowable concentration of ions derived from Zr compounds in a treatment solution depends on the concentration of Zr ions in the treatment solution and is within 10 times the concentration of Zr ions.

The inventors engaged in studies based on the above findings and thereby solved the above problems. The gist of the present invention is as follows.

(1) A method of production of chemically treated steel sheet which continuously treats a steel strip by cathode electrolysis in a treatment solution containing zirconium ions and fluorine ions to form a chemically treated coating containing zirconium on said steel strip, the method of production of chemically treated steel sheet characterized by using two or more types of zirconium compounds selected from zirconium halides, zirconium hydroxide, zirconium carbonate, zirconium ammonium salts, zirconium nitrate, zirconium sulfate, zirconium acetate, zirconium ammonium fluoride, and Zr hydrofluoride to resupply zirconium ions in said treatment solution during the cathode electrolysis and maintaining a content of ions in said treatment solution at zirconium ions: 0.05 to 30 g/liter, fluorine ions: 0.5 to 10 times the content of the zirconium ions, and ions derived from said two or more types of zirconium compounds other than zirconium ions and fluorine ions: not more than 10 times the content of the zirconium ions in performing the cathode electrolysis.

(2) A method of production of chemically treated steel sheet of the above (1) characterized in that said treatment solution further contains phosphate ions, the method resupplies the phosphate ions using phosphoric acid in said treatment solution during said cathode electrolysis, and the method maintains the content of phosphate ions in said treatment solution at 0.05 to 30 g/liter in performing the cathode electrolysis.

Advantageous Effects

According to the present invention, there is provided a method of production of chemically treated steel sheet using cathode electrolysis to form a chemically treated coating on a steel strip which enables stable resupply of Zr ions in a treatment solution. As a result, it becomes possible to use an insoluble anode to continuously treat a steel strip by cathode electrolysis by a treatment solution containing Zr ions and fluorine ions.

DESCRIPTION OF EMBODIMENTS

Figure 1:
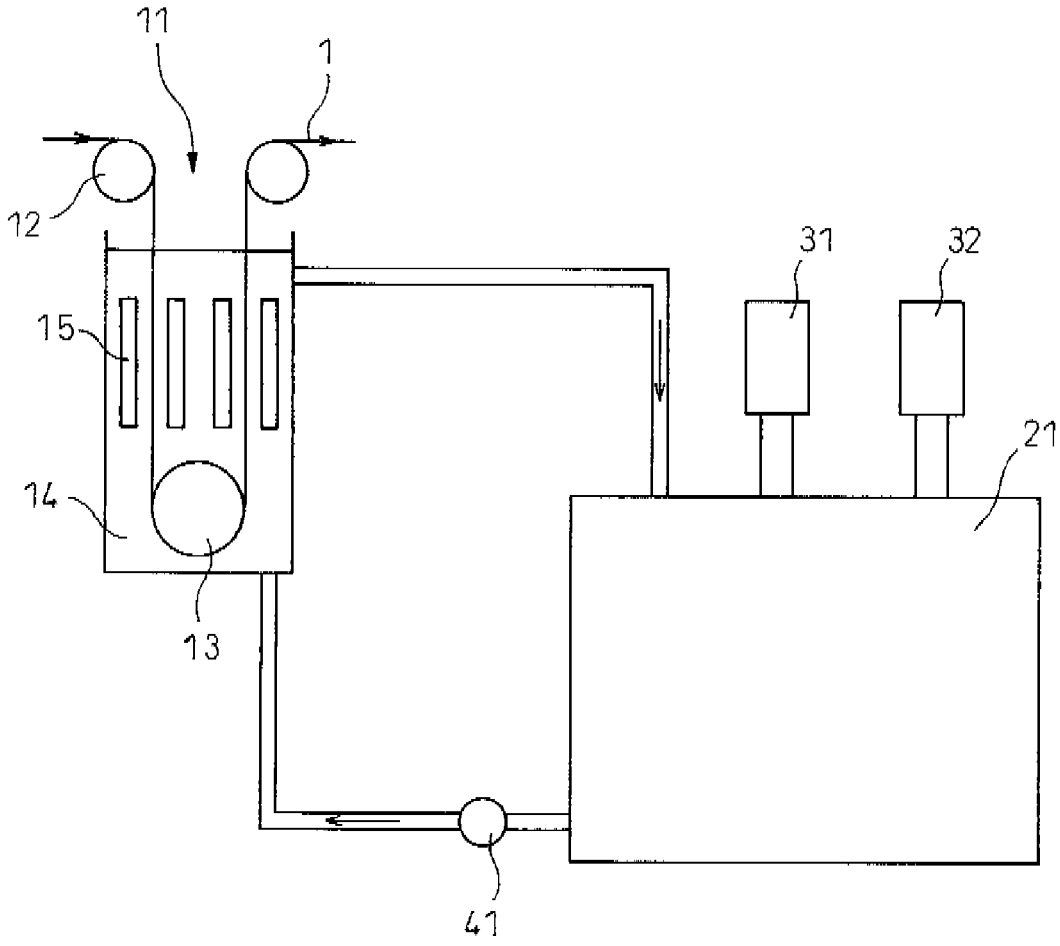
FIG. 1 is a view conceptually showing an example of a continuous electroplating apparatus for the case when resupplying Zr ions by two types of Zr compounds.

Below, preferred embodiments of the present invention will be explained in detail.

The steel strip used in the present invention is not particularly limited. Usually, coiled steel sheet is used. The steel sheet may also be plated with Ni, Sn, Zn, etc.

The strip of steel sheet unwound from the coil is immersed in an electrolytic Zr treatment solution and treated by cathode electrolysis to form a Zr oxide or Zr phosphate Zr-based coating. The electrolytic Zr treatment solution may contain Zr ions, fluorine ions, and phosphate ions.

Fluorine ions form complexes with Zr ions and are required for ensuring the stability of the Zr ions. The amount of fluorine ions necessary for ensuring stability is at least 0.5 time the mass concentration of Zr ions in the treatment solution. If the amount of fluorine ions is less than 0.5 time the mass concentration of Zr ions in the treatment solution, the amount of fluorine ions for forming the complex ions will be insufficient and the Zr ions will lose stability and easily precipitate. As a result, formation of the coating will become unstable and the desired performance will not be able to be exhibited.

If the amount of fluorine ions exceeds 10 times the mass concentration of Zr ions in the treatment solution, the Zr coating precipitated once on the steel sheet will be etched by the excess fluorine ions and dissolved. As a result, the desired amount of deposition will not be able to be secured and superior properties will not be exhibited either. Therefore, the amount of fluorine ions in the treatment solution has to be made 0.5 to 10 times the amount of the Zr.

Phosphate ions cause the precipitation of a Zr phosphate compound and gives a plated steel sheet superior in corrosion resistance, rustproofing, and coating adhesion. Simultaneously, the strong acid of phosphoric acid has the function of adjusting the pH of the electrolytic Zr treatment solution to an acid region where stable Zr electrolysis is easy (pH5 or less).

The lower the concentrations of Zr ions and phosphate ions, the more advantageous cost-wise. However, if the concentrations of Zr ions and phosphate ions become too low, the efficiency of precipitation of the Zr coating will fall and the electrical conductivity will fall resulting in a power loss. Therefore, the concentrations of Zr ions and phosphate ions have to be respectively made 0.05 g/liter or more.

The higher the concentrations of Zr ions and phosphate ions, the better the efficiency of precipitation of the Zr coating. However, the treatment solution would become more expensive and the loss due to the treatment solution being taken out while deposited on the steel sheet would become greater. Further, the solution would increase in viscosity, so the amount of solution taken out by the steel sheet would become greater—which would be industrially extremely disadvantageous. Therefore, in the present invention, the concentrations of Zr and phosphate ions are made respectively 30 g/liter or less.

If applying electrolysis continuously, the ingredients precipitated on the steel sheet, that is, the concentration of Zr ions in the treatment solution and the concentration of phosphate ions, will fall. Further, due to being taken out by the steel sheet, the concentration of Zr ions, concentration of phosphate ions, and concentration of fluorine ions will drop. The drop in the Zr and other solution ingredients due to takeout will not affect the suitable ratio of concentration between Zr ions and fluorine ions. However, the drop in the concentration of Zr ions due to precipitation will result in the ratio of fluorine ions becoming higher, so will affect the suitable ratio of concentration between Zr ions and fluorine ions.

To resupply the Zr ions and maintain a suitable concentration of fluorine ions in the treatment solution, two or more types of Zr compounds selected from zirconium halides, zirconium hydroxide, zirconium carbonate, zirconium ammonium salts, zirconium nitrate, zirconium sulfate, zirconium acetate, and hexafluorozirconic acid may be used to resupply the Zr ions.

At this time, the concentration of the ions forming compounds with the Zr has to be made within 10 times the concentration of Zr ions in the treatment solution. If the ion concentration exceeds 10 times the Zr ion concentration, while there is some difference in effect depending on the type of the ions, the formation of a Zr coating will become destabilized at the time of electrolysis and the desired performance will be degraded as an increasing trend. Here, the "ions" mean ions derived from Zr compounds other than fluorine ions and phosphate ions such as chlorine ions and other halogen ions, hydroxide ions, carbonate ions, ammonium ions, nitrate ions, sulfate ions, and acetate ions.

The Zr compound charged may be any type so long as the concentration of one ion in the treatment solution is within 10 times the concentration of Zr ions.

Here, when using one type of Zr compound to resupply the Zr ions, the amount of the ions forming the Zr compound resupplied becomes greater than the amount taken out by the steel sheet, so the concentration is not kept down and in the end exceeds 10 times the concentration of Zr ions.

For this reason, for resupplying Zr ions, it is necessary to use two or more types of Zr compounds. As a result, the amounts of the ions forming the Zr compounds resupplied become equal to the amounts taken out by the steel sheet. It is possible to keep the amount in a range not exceeding 10 times the concentration of Zr ions.

When the amount taken out by the treatment solution is large, two types of Zr compounds may be used to resupply the Zr ions. When the amount taken out by the treatment solution is small, even if using two types of Zr compounds, sometimes it will not be possible to keep down the concentration due to the takeout by the steel sheet. In this case, three or more types of Zr compounds are added.

The Zr ions may be resupplied by a certain concentration and rate based on the assumed amount of consumption of Zr ions and the amount of other takeout of ions. Further, the ion concentration of the treatment solution may be measured and the concentration and rate adjusted based on the results.

When using two types of Zr compounds, for example, if combining fluorine compounds with other compounds such as Zr fluoride and Zr carbonate or Zr fluoride and Zr nitrate, it would be possible to simultaneously resupply the fluorine ions of the other main ingredient of the treatment solution.

If three types, using Zr hydroxide, Zr ammonium salts, etc. in addition to the above two types including Zr fluoride, it would be possible to adjust the concentrations of the ions more finely.

The "Zr ammonium salts" are, for example, ammonium zirconium carbonate ($(NH_4)_2[Zr(CO_3)_2(OH)_2]$) etc.

The electrolysis facility used in the present invention is not particularly limited. A vertical or horizontal type known electrolysis facility may be used. The insoluble anode is also not particularly limited. A Pt or Pb or metal oxide electrode or other known insoluble anode may be used.

The concentration of the Zr ions, fluorine ions, and other ions in the treatment solution may be measured by atomic spectroscopy, ICP optical emission spectrometry, ion chromatography, etc.

The cathode electrolysis according to the present invention may be performed, for example, by a current density of 0.1 to 20 A/dm$^2$.

FIG. 1 is a view showing schematically an example of an apparatus for the case of using two types of Zr compounds to resupply Zr ions in the method of the present invention.

In FIG. 1, a conductor roll 12 is a metal roll which contacts the steel strip 1 and carries current. This conductor roll 12 is connected with a DC power supply. The steel strip 1 therefore becomes the cathode. The insoluble anode 15 is an electrode made of platinum or another high corrosion resistance metal or an electrode coated at the steel strip side. It is connected with a DC power supply and becomes the anode.

A sink roll 13 is a rubber roll for changing the direction of progression of the steel strip 1. Zr resupply tanks 31, 32 are filled with liquid or powder state Zr compounds. Zr compounds charged into the resupply tanks are fed to a recirculation tank 21 in accordance with the consumption of Zr in the treatment solution 14 by a solenoid valve (not shown) etc. From the recirculation tank 21, a pump 41 is used to fed the treatment solution to the treatment tank 11. The treatment solution overflowing from the top of the treatment tank 11 is returned to the recirculation tank 21.

EXAMPLES

Below, examples will be used to explain the present invention in further detail.

Example A

A treatment solution comprised of Zr ions: 1.4 g/liter, fluorine ions: 1.7 g/liter, phosphate ions: 1.2 g/liter and having a pH2.8 in an amount of 15 m$^3$ was used to treat a coil of a sheet thickness; 0.2 mm, sheet width: 1000 mm at a speed of 250 m/min to deposit 8 mg/m$^2$ of Zr coating per side over 8000 hours.

The Zr ions were resupplied in the treatment solution by a hexafluorozirconic acid ($H_2ZrF_6$) solution having a concentration of Zr ions of 17 g/liter. The amount of resupplied solution was made an amount corresponding to the amount taken out by the steel strip (10 liter/hr). The phosphate ions were resupplied by adding an amount corresponding to the takeout (about 22 g/hr) by phosphoric acid.

Every 8 hours, ICP optical emission spectrometry was used to measure the concentration of Zr ions in the treatment solution while ion chromatography was used to measure the concentration of fluorine ions and the concentration of phosphate ions. A pH meter was used to measure the pH.

Figure 2:
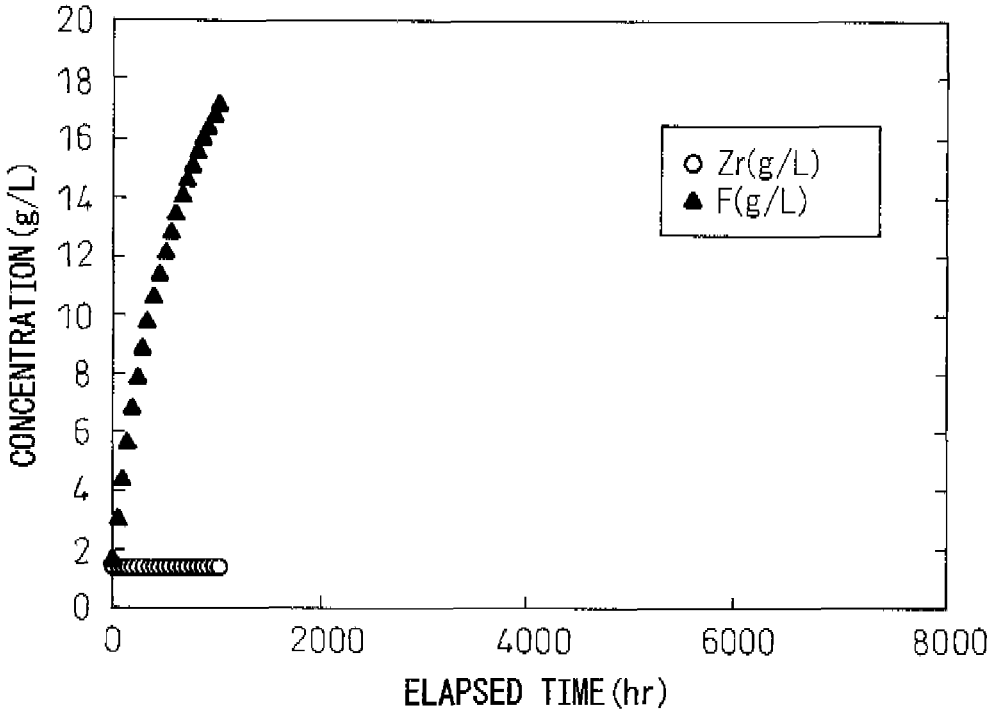
FIG. 2 is a view showing the changes over time of the concentrations of Zr and fluorine ions when using hexafluorozirconic acid to resupply Zr ions in a treatment solution during cathode electrolysis.

FIG. 2 shows the changes over time in the concentration of Zr ions and the concentration of fluorine ions. The concentration of Zr ions stabilized at about 1.4 g/liter. The concentration of phosphate ions stabilized at 1.1 to 1.3 g/liter, while the pH stabilized at 2.7 to 2.9. However, as shown in FIG. 2, if over about 650 hr, the concentration of fluorine ions exceeded 10 times the concentration of Zr ions, that is, 14 g/liter, and the coating performance deteriorated, so the treatment was stopped at 1000 hr.

Example B

A treatment solution comprised of Zr ions: 1.4 g/liter, fluorine ions: 1.7 g/liter, phosphate ions: 1.2 g/liter, and nitrate ions: 1.7 g/liter and having a pH2.8 in an amount of 15 m$^3$ was used to treat a coil of a sheet thickness: 0.2 mm, sheet width: 1000 mm at a speed of 250 m/min to deposit 8 mg/m$^2$ of Zr coating per side over 8000 hours.

The Zr ions were resupplied by a mixed solution of hexafluorozirconic acid and zirconium nitrate (by weight ratio, hexafluorozirconic acid:zirconium nitrate=55:45) having a concentration of Zr ions of 17 g/liter. The amount of resupplied solution was made an amount corresponding to the amount taken out by the steel strip (10 liter/hr). The phosphate ions were resupplied by adding an amount corresponding to the takeout (about 22 g/hr) by phosphoric acid.

Every 8 hours, ICP optical emission spectrometry was used to measure the concentration of Zr ions in the treatment solution while ion chromatography was used to measure the concentration of fluorine ions, the concentration of phosphate ions, and the concentration of nitrate ions. A pH meter was used to measure the pH.

Figure 3:
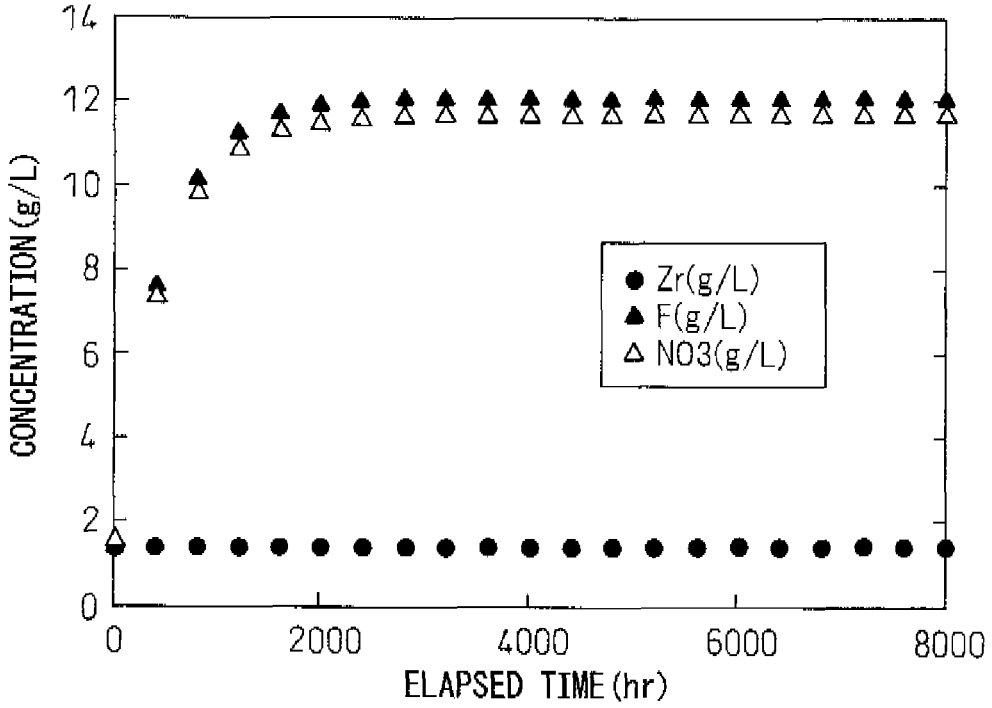
FIG. 3 is a view showing the changes over time of the concentrations of Zr and fluorine ions when using a hexafluorozirconic acid and Zr nitrate mixed solution to resupply Zr ions in a treatment solution during cathode electrolysis.

FIG. 3 shows the changes over time in the concentration of Zr ions, the concentration of fluorine ions, and the concentration of nitrate ions. The concentration of Zr ions stabilized at about 1.4 g/liter. The concentration of phosphate ions stabilized at 1.1 to 1.3 g/liter, while the pH stabilized at 2.7 to 2.9. Further, as shown in FIG. 3, if over 2000 hr, the concentrations of fluorine ions and nitrate ions stabilized at 12 g/liter and the coating performance was also excellent. The concentrations of fluorine ions and nitrate ions concentration are believed to have stabilized since the amounts of takeout by the steel sheet and amounts of resupply became substantially equal.

Example C

The following Treatment Methods 1 to 3 were used to prepare test materials.

Treatment Method 1

A cold rolled, annealed, temper rolled sheet material of a sheet thickness of 0.2 mm was degreased and pickled, then treated by a treatment solution containing Zr ions by cathode electrolysis to 0.5 A/dm$^2$ so as to deposit a Zr electrolytic coating in an amount, converted to Zr metal, of 40 mg/m$^2$.

Treatment Method 2

A cold rolled, annealed, temper rolled sheet material of a sheet thickness of 0.2 mm was degreased and pickled, plated with Ni using a Ferrostan bath to 1 g/m$^2$, then treated by a treatment solution containing Zr ions by cathode electrolysis to 0.5 A/dm$^2$ so as to deposit a Zr electrolytic coating in an amount, converted to Zr metal, of 10 mg/m$^2$.

Treatment Method 3

A cold rolled, annealed, temper rolled sheet material of a sheet thickness of 0.2 mm was degreased and pickled, plated with Ni using a watt bath to 0.4 g/m$^2$, then further treated by a treatment solution containing Zr ions by cathode electrolysis to 0.5 A/dm$^2$ so as to deposit a Zr electrolytic coating in an amount, converted to Zr metal, of 8 mg/m$^2$.

The above test materials were evaluated for performance by the items of (a) to (c) shown below:

(a) Corrosion Resistance

The test material was coated with an epoxy phenol resin, baked at 200° C. for 30 min, cross-cut to a depth reaching the base iron, immersed in a test solution comprised of mixed solution of 1.5% citric acid-1.5% saline at 45° C. for 72 hours, then washed, dried, then stripped by tape.

The state of corrosion under the coating at the cross-cut parts and the state of corrosion at the flat sheet parts were evaluated as follows by four stages.

A: No corrosion under the coating observed

B: Slight corrosion under the coating of extent not posing practical problem observed C: Small corrosion under the coating and slight corrosion at the flat sheet parts observed D: Severe corrosion under the coating and corrosion at the flat sheet parts observed (b) Rustproofing The test material was, allowed to stand in an atmosphere alternating between the two states of a humidity of 90% for 2 hours and a humidity of 40% for 2 hours for a total of two months. The state of rusting was evaluated as follows by four stages.

A: No rusting at all

B: Very slight rusting of extent not posing practical problem

C: Slight rusting

D: Rusting at majority of parts (c) Coating Adhesion

The test material was coated with an epoxy phenol resin, baked at 200° C. for 30 min, cross-cut to a depth reaching the base iron at 1 mm intervals, and stripped by tape. The peeled state was evaluated as follows by four stages.

A: No peeling at all

B: Very slight peeling of extent not posing practical problem

C: Slight peeling

D: Peeling at majority of parts

The results of the tests are shown in Table 1.

TABLE 1

| | Test Material No. | Treatment method | Solution: Zr am't (g/l) | Fluorine (g/l) | Nitric acid (g/l) | Ammonium (g/l) | Acetic acid (g/l) | Sulfuric acid (g/l) | Chlorine (g/l) | Phosphoric acid (g/l) | Weight ratio to Zr: Fluorine | Nitric acid | Ammonium |
|---|---|---|---|---|---|---|---|---|---|---|---|---|---|
| Inv. ex. | 1 | 2 | 28 | 25.2 | 162.4 | 0 | 0 | 0 | 0 | 14 | 0.9 | 5.8 | |
| | 2 | 3 | 0.07 | 0.21 | 0.476 | 0 | 0 | 0 | 0 | 0.07 | 3 | 6.8 | |
| | 3 | 2 | 3 | 16.2 | 26.4 | 0 | 0 | 0 | 6.9 | 1.3 | 5.4 | 8.8 | |
| | 4 | 3 | 10 | 40 | 68 | 0 | 15 | 0 | 0 | 12 | 4 | 6.8 | |
| | 5 | 2 | 22 | 105.6 | 169.4 | 0 | 0 | 0 | 0 | 28 | 4.8 | 7.7 | |
| | 6 | 3 | 0.1 | 0.7 | 0 | 0.88 | 0 | 0 | 0 | 0.06 | 7 | | 8.8 |
| | 7 | 2 | 0.9 | 0.495 | 0 | 1.98 | 0 | 0 | 0 | 0.1 | 0.55 | | 2.2 |
| | 8 | 3 | 4 | 38 | 39.2 | 0 | 0 | 0 | 0 | 0.7 | 9.5 | 9.8 | |
| | 9 | 1 | 10 | 20 | 94 | 0 | 0 | 42 | 0 | 4 | 2 | 9.4 | |
| | 10 | 1 | 10 | 34 | 55 | 55 | 0 | 0 | 0 | 3 | 3.4 | 5.5 | 5.5 |
| | 11 | 2 | 10 | 15 | 0 | 0 | 0 | 44 | 0 | 3 | 1.5 | | |
| | 12 | 3 | 10 | 40 | 69 | 0 | 69 | 0 | 0 | 4 | 4 | 6.9 | |
| Comp. ex. | 13 | 3 | 0.9 | 3.6 | 0 | 10.8 | 0 | 0 | 0 | 3 | 4 | | 12 |
| | 14 | 1 | 1.4 | 0.63 | 0 | 4.76 | 0 | 0 | 0 | 3 | 0.45 | | 3.4 |
| | 15 | 1 | 6 | 66 | 27 | 27 | 0 | 0 | 0 | 3 | 11 | 4.5 | 4.5 |
| | 16 | 2 | 7 | 84 | 17.5 | 0 | 0 | 0 | 7.7 | 0.03 | 12 | 2.5 | |
| | 17 | 3 | 0.02 | 0.06 | 0.11 | 0 | 0 | 0 | 0 | 4.2 | 3 | 5.5 | |
| | 18 | 1 | 12 | 4.08 | 0 | 40.8 | 0 | 0 | 0 | 6.8 | 0.34 | | 3.4 |

TABLE 1-continued

| | Test | Solution | | | | Coating characteristics | | |
|---|---|---|---|---|---|---|---|---|
| | | Weight ratio to Zr | | | | | | |
| | Material No. | Acetic acid | Sulfuric acid | Chlorine | pH | Corrosion resistance | Rust-proofing | Coating adhesion |
| Inv. | 1 | | | | 4.2 | A | A | A |
| ex. | 2 | | | | 3.8 | A | A | A |
| | 3 | | | 2.3 | 2.2 | A | A | A |
| | 4 | 1.5 | | | 2.8 | A | A | A |
| | 5 | | | | 3.4 | A | A | A |
| | 6 | | | | 3.9 | A | A | A |
| | 7 | | | | 4.2 | A | A | A |
| | 8 | | | | 4.2 | A | A | A |
| | 9 | | 4.2 | | 3.5 | B | B | A |
| | 10 | | | | 3.5 | B | B | A |
| | 11 | | 4.4 | | 2.4 | A | A | A |
| | 12 | 6.9 | | | 1.8 | A | A | A |
| Comp. | 13 | | | | 4.2 | C | D | D |
| ex. | 14 | | | | 4.2 | D | D | D |
| | 15 | | | | 3.5 | D | D | D |
| | 16 | | | 1.1 | 5.5 | D | D | D |
| | 17 | | | | 2.2 | D | D | D |
| | 18 | | | | 3.9 | D | D | D |

Above, preferred embodiments of the present invention were explained, but the present invention is not limited to the above examples of course.

INDUSTRIAL APPLICABILITY

According to the present invention, there is provided a method of production of a chemically treated steel sheet using cathode electrolysis to form a chemically treated coating on a steel strip which can stably resupply Zr ions in a treatment solution and can use an insoluble anode to continuously treat a steel strip by cathode electrolysis by a treatment solution containing Zr ions and fluorine ions. Therefore, the contribution to the ferrous metal industry producing plated steel sheet is tremendous and the industrial applicability is great.

REFERENCE SIGNS LIST

1 steel strip
11 treatment tank
12 conductor roll
13 sink roll
14 treatment solution
15 insoluble anode
21 recirculation tank
31,32 Zr resupply tank
41 pump

The invention claimed is:

1. A method of production of a chemically treated steel sheet, comprising:

continuously supplying a steel strip into a treatment solution containing zirconium ions and fluorine ions and treating the steel strip by cathode electrolysis in the treatment solution containing zirconium ions and fluorine ions to form a chemically treated coating containing zirconium on the steel strip, resupplying zirconium ions in the treatment solution with at least two compounds, wherein the at least two compounds are selected from the group consisting of a fluorine compound and a different compound which is not a fluorine compound, wherein the fluorine compound is selected from the group consisting of a compound including zirconium and fluorine, and zirconium fluoride, and wherein the different compound which is not a fluorine compound is selected from the group consisting of zirconium halides, zirconium hydroxide, zirconium carbonate, zirconium ammonium salts, zirconium nitrate, zirconium sulfate and zirconium acetate, during the cathode electrolysis to maintain the zirconium ions in the treatment solution at 0.05 to 30 g/liter, to maintain the fluorine ions in the treatment solution at 0.5 to 10 times the content of the zirconium ions, and to maintain each kind of ion, other than the zirconium ions and the fluorine ions, derived from the fluorine compound and the different compound which is not a fluorine compound, in the treatment solution at not more than 10 times the content of the zirconium ions, wherein the ions other than the zirconium ions and the fluorine ions, derived from the fluorine compound and the different compound which is not a fluorine compound, are selected from the group consisting of chlorine ions, bromine ions, iodine ions, hydroxide ions, carbonate ions, ammonium ions, nitrate ions, sulfate ions and acetate ions, and wherein the amount of resupplied solution is an amount corresponding to the amount of the treatment solution taken out by the steel strip.

2. The method of production of a chemically treated steel sheet as set forth in claim 1, wherein the treatment solution further comprises phosphate ions, and the method further comprises resupplying the phosphate ions using phosphoric acid in the treatment solution during the cathode electrolysis to maintain the content of phosphate ions in the treatment solution at 0.05 to 30 g/liter, and maintaining the pH of the treatment solution at 5 or less, wherein the amount of resupplied phosphate ions is an amount corresponding to the amount taken out by the steel strip.

3. The method of production of a chemically treated steel sheet as set forth in claim 1, wherein the zirconium ions are resupplied by a certain concentration and rate based on the assumed amount of consumption of the zirconium ions and the amount of other ions being taken out by the steel sheet.

4. The method of production of a chemically treated steel sheet as set forth in claim 1, wherein the ion concentration of the treatment solution is measured and the concentration and rate of the resupplied solution is adjusted based on the results.

* * * * *